United States Patent [19]

Roberts

[11] Patent Number: 4,961,265

[45] Date of Patent: Oct. 9, 1990

[54] SIGHT MOUNTING DEVICE FOR ARCHERY BOWS

[75] Inventor: Kent S. Roberts, American Fork, Utah

[73] Assignee: Roberts Mfg., Inc., American Fork, Utah

[21] Appl. No.: 332,878

[22] Filed: Apr. 3, 1989

[51] Int. Cl.[5] ..... F41G 1/467

[52] U.S. Cl. ..... 33/265; 124/87

[58] Field of Search ..... 33/265, 247, 248; 124/87, 88

[56] References Cited

U.S. PATENT DOCUMENTS

| | | | |
|---|---|---|---|
| 2,155,391 | 4/1939 | Arden | 33/247 |
| 2,306,972 | 12/1942 | Meisel | 33/247 |
| 2,559,927 | 7/1951 | Beloungy | 33/265 |
| 2,669,023 | 2/1954 | Pizzuti | 33/265 |
| 3,266,149 | 8/1966 | Powell | 33/265 |
| 4,026,032 | 5/1977 | Smith | 33/265 |
| 4,237,615 | 12/1980 | Bracknell | 33/265 |
| 4,291,469 | 9/1981 | Weast | 33/265 |
| 4,294,017 | 10/1981 | Byrnes et al. | 33/265 |
| 4,417,403 | 11/1983 | Strange | 33/265 |
| 4,528,973 | 7/1985 | Rasmussen | 124/87 |
| 4,553,338 | 11/1985 | LeBeau | 33/265 |
| 4,602,437 | 7/1986 | Berthiaume | 33/265 |
| 4,616,623 | 10/1986 | Williams | 33/265 |
| 4,660,289 | 4/1987 | Wilhide | 33/265 |
| 4,715,126 | 12/1987 | Holt | 33/265 |

*Primary Examiner*—William A. Cuchlinski, Jr.
*Assistant Examiner*—Patrick R. Scanlon
*Attorney, Agent, or Firm*—Mallinckrodt & Mallinckrodt

[57] ABSTRACT

An archery bow sight mounting device having a mechanism means for adjusting the vertical launch trajectory of an arrow through an angle of ten degrees or more in closely spaced steps of 20 minutes of arc, or less, having structure to inhibit an accidental misadjustment, and having indica for calibrating range with respect to each adjustment. Structure is also provided for adjusting the transverse launch trajectory angle to compensate for variations between bows or archers. The device has a bracket which can be attached to the bow, a pair of sight mounting members adjustably affixed to the bracket and adapted for axially mounting the sight, attachment structure for pivotally mounting the first sight mounting member to the bracket, attachment structure for mounting the second sight mounting member to the bracket such that the second sight mounting member can move arcuately about the first sight mounting member, an a user operated member which drives the second sight mounting member and which employs a detent member cooperating with a catch member thus permitting the second sight mounting member to be adjusted to thirty or more different positions.

27 Claims, 2 Drawing Sheets

SIGHT MOUNTING DEVICE FOR ARCHERY BOWS

BACKGROUND OF THE INVENTION

1. Field

The invention is in the field of sight mounting devices for archery bows.

2. State of the Art

Sights for archery bows are usually pin sights, tube sights, or scope sights. In each case, range adjustment is provided for and the bow is calibrated for various estimated ranges to potential targets. Indicia are often applied to the mounting device for identifying the preset ranges.

In order to accommodate the usual variations in ranges, sight mounting devices have often incorporated means for allowing the launch trajectory sight line to be tilted through an elevation angle of up to ten degrees or more, so that the arrow may be launched either approximately parallel to the terrain or upwardly at an angle to the terrain. It has been recognized that this angular range adjustment should be such that it can be made quickly, without the use of tools, and that it be capable of being set to predetermined range calibration indices. Detent or latch means have sometimes been provided, so that, once set to a selected range, the adjustment is protected from being accidentally or inadvertently changed. Additionally, provision has sometimes been made for transverse adjustment of the launch trajectory sight line angle in order to accommodate slight inaccuracies in the bow or variations between different bows and between different archers.

SUMMARY OF THE INVENTION

In accordance with the invention, all of these features of the prior art are incorporated in a new sight mounting device which has the advantage of being relatively simple, compact, and inexpensive. Most important, this new construction provides for mounting a standard scope gunsight in operable condition on an archery bow.

The new device comprises an elongate mounting bracket which can be attached to the bow handle, a pair of sight mounting members to which a standard scope gunsight can be fixedly attached, adjustable attachment means securing the sight mounting members to the bracket in longitudinally spaced relationship therealong, and range selection means identifying preselected ranges and for adjusting the sight to these ranges.

One of these sight mounting members is pivotally attached to the bracket by means of a pivot post. The second sight mounting member is movably attached to the bracket so that it moves in an arcuate path, pivoting as necessary as the first sight mounting member is pivoted to different positions. Thus, the launch trajectory sight line can be adjusted so that an arrow may be launched substantially parallel to the terrain or at any selected angle of elevation up to approximately ten degrees or more when the sight is trained on the target. The angle of elevation is chosen in accordance with the range desired.

In one embodiment of the invention, a cam member is provided as means for adjusting the launch trajectory angle of elevation. Such cam member comprises a circular disc rotatably attached at its center to the bracket and having an offset, arcuate slot therethrough in which a post member that is affixed to the second sight mounting member is positioned. The slot is so arranged that, as the disc is rotated, the second sight mounting member is urged to travel in an arcuate path having as its center the pivotal mounting point of the first sight mounting member. In order to accommodate this arcuate motion, the bracket has an arcuate slot therethrough in which the post member of the second sight mounting member is positioned. Thus, means are provided for pivoting the axis of the sight from a position substantially parallel to the terrain to any selected elevation angle up to the maximum allowed by the arcuate slots, which may be ten degrees or more.

The cam member preferably has a handle affixed thereto to facilitate operator adjustment, and is also serrated around a portion of its periphery to serve as detents for cooperating with a catch member, which, in turn, is spring mounted on the bracket. Preferably, there are approximately forty such serrations providing almost the same number of positions to which the cam member may be adjusted. Thus, arrow launch trajectory settings varying from each other by less than twenty minutes of arc may be effected. Indicia are usually provided around the periphery of the cam member, with an index mark being located on the bracket.

If even finer adjustments are desired than can be effected by the detent means, the catch member can be removed or the device can be made in the first place without detent means. This then, will allow continuously variable adjustment. Once adjusted to a desired range, a mounting screw is tightened thus preventing inadvertent misadjustment of the range.

Another embodiment of the device utilizes a screw-threaded arrangement as the means for adjusting the launch trajectory angle of elevation, i.e. the setting of the second sight mounting member. In this embodiment, instead of a cam member, a movable sight adjustment member is employed having a slot therethrough in which the post member that is affixed to the second sight mounting member is positioned. Such movable sight adjustment member is threadedly engaged by a transverse screw, which, in turn, is journaled in the bracket, all being so arranged that, as the screw is rotated, the movable sight adjustment member slides linearly on the bracket urging the post member attached to the second sight mounting member to move arcuately in the bracket slot. A thumbwheel on the end of the screw is equipped with detents which cooperate with a spring-loaded ball check affixed to the bracket, thus providing a set number of range settings. Indicia are usually provided around the thumb wheel, with an index mark being located on the bracket.

In addition, as above, if even finer adjustments are desired than can be effected by the ball check means the ball check may be removed, thus allowing continously variable adjustment.

In both of these embodiments, a feature of the invention is the provision of means for adjusting the spacing of the first sight mounting member with respect to the bracket such that transverse adjustment of the launch trajectory angle can be effected. This is advantageously accomplished by providing compression springs which urge the first sight mounting member away from the bracket, the first sight mounting member being restrained by engagement with the head of its pivot post. Adjustment is effected by turning a locking nut that is threaded onto the end of the pivot post.

Both sight mounting members are advantageously attached to the bracket by posts which are headed on one end and threaded on the opposite end, the headed end being engaged with its respective sight mounting member and the threaded end having a locking nut threaded thereon. Such locking nut is tightened snugly, but not tightly, such that the sight mounting member may pivot without the nut either tightening or loosening on the post.

THE DRAWINGS

The best modes presently contemplated for carrying out the invention are shown in the accompanying drawings in which:

FIG. 1 is a side elevational view of one embodiment of the sight mounting device as adjusted for minimum range, a standard scope gunsight being attached to and properly mounted by the device relative to an archery bow that is indicatd by broken lines;

FIG. 2, a view corresponding to that of FIG. 1 but with the device adjusted for maximum range;

FIG. 3, a view in front elevation of the device as shown in FIG. 1;

FIG. 4, a view corresponding to that of FIG. 3 but taken with respect to FIG. 2;

FIG. 5, a fragmentary vertical section taken on the line 5—5 of FIG. 3;

FIG. 6, a fragmentary vertical section taken on the line 6—6 of FIG. 5 and drawn to a larger scale;

FIG. 7, a fragmentary vertical section taken on the line 7—7 of FIG. 5 and drawn to the larger scale of FIG. 6;

FIG. 8, a fragmentary section taken on the line 8—8 of FIG. 2 and drawn to the larger scale of FIGS. 6 and 7;

FIG. 9, a fragmentary horizontal section taken on the line 9—9 of FIG. 5 and drawn to the larger scale of FIGS. 6–8;

FIG. 10, a view similar to that of FIG. 1, but drawn to a larger scale and showing another embodiment of the invention with the device adjusted for minimum range and indicating in broken lines only part of the attached scope sight;

FIG. 11, a vertical section taken on the line 11—11 of FIG. 10, with the scope sight being shown in full lines, its elevated position being indicated by broken lines;

FIG. 12, a fragmentary vertical section taken on the line 12—12 of FIG. 11 and drawn to a larger scale;

FIG. 13, a fragmentary vertical section corresponding to FIG. 9 but showing an alternative embodiment.

DETAILED DESCRIPTION OF THE ILLUSTRATED EMBODIMENTS

Figure 1:
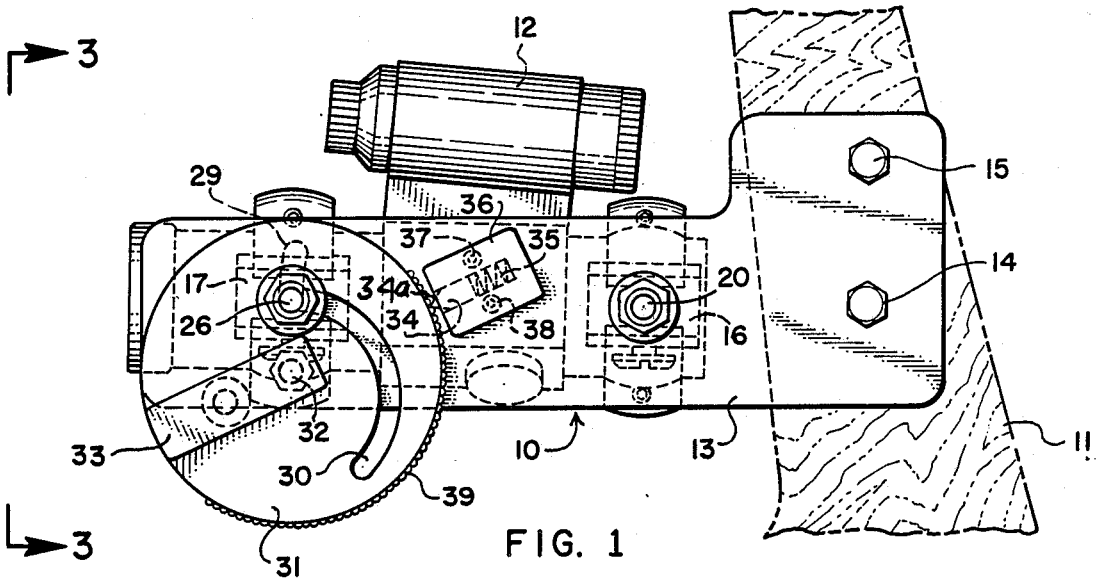

In FIG. 1, the sight mounting device 10 is attached to an archery bow 11 near the handgrip and has a standard scope gunsight 12 attached thereto. Device 10 comprises an L-shaped bracket 13, which is shown fastened to the bow 11 by means of bolts 14 and 15, a sight mounting member 16, and a second sight mounting member 17 spaced from the first longitudinally of bracket 13. Sight 12 is fixedly attached to the mounting members by respective means described herebelow.

In practice, the scope sight is adjusted for range by pivoting it about a central axis of the first sight mounting member 16. In consequence thereof second sight mounting member 17 moves in an arcuate path centered about the axis of first sight mounting member 16. Thus, the axis of the scope is tilted upwardly or downwardly depending on the range of the target, and thus varies the launch trajectory as the scope is sighted on the target.

Figure 5:
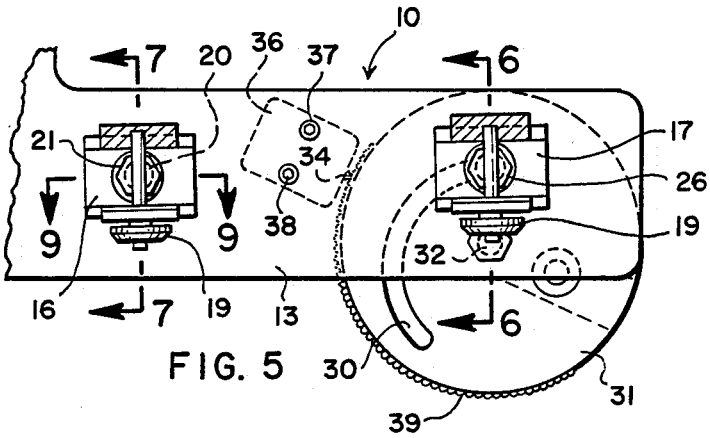
Figure 7:
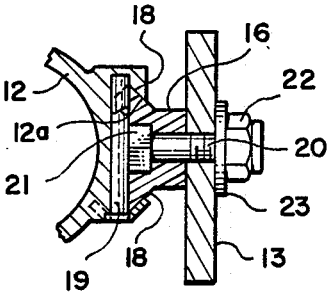

The first sight mounting member 16 is shown enlarged and in cross section in FIG. 7, which also shows the attachment means for pivotally attaching it to bracket 13. As shown, sight mounting member 16 is preferably fashioned from a molded elongate block, having wedge-shaped surfaces 18 thereon which slidably engage mating surfaces 12*a*, FIG. 7, on the scope sight. Once mated the scope sight is locked in place by respective locking means 19 which are a part of the scope sight. Also as shown in FIG. 7, sight mounting member 16 has a transverse hole passing therethrough. A pivot post 20 is inserted through such hole and also through an aligned hole in bracket 13. The pivot post 20 is threaded on one end and headed on the opposite end 21. Headed end 21 is hexagonal, as shown in FIGS. 5 and 7, which mates with a corresponding hexagonal recess in sight mounting member 16. Thus, pivot post 20 and sight mounting member 16 pivot together and cannot pivot separately. A self-locking nut 22, having an internally threaded plastic insert, is threaded on the threaded end of pivot post 20, which firmly affixes the two together. Alternative locking means, such as jamb nuts, may be used in place of a self-locking nut if desired. In any event, the nut means is tightened just sufficiently that the first sight mounting member is restrained from moving axially, and, also, so that the force required to rotate the pivot post 20 with respect to the bracket 13 is significantly less than the force required to rotate the pivot post with respect to the nut means. Thus, pivot post 20, sight mounting member 16, and nut 22 rotate freely together when sight mounting member 16 pivots as the scope sight is adjusted. Furthermore, repetitive rotations do not result in either tightening or loosening of the nut means on the pivot post. In addition, as an option, a washer 23 may be interposed between nut 22 and bracket 13, as shown in FIG. 7. Preferably this washer will have smooth surfaces, such that the coefficient of friction between the nut and the washer and the washer and the bracket is low, thus facilitating the pivoting of sight mounting member 16.

Figure 2:
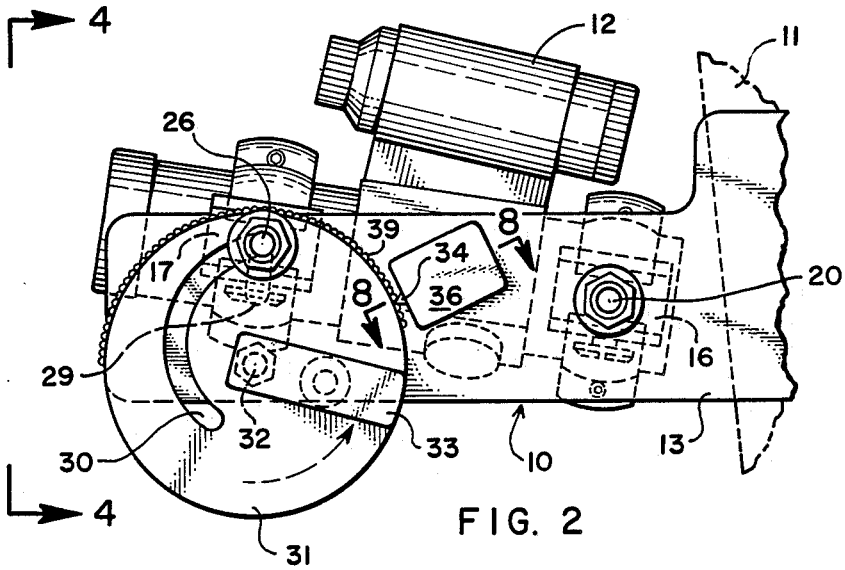
Figure 6:
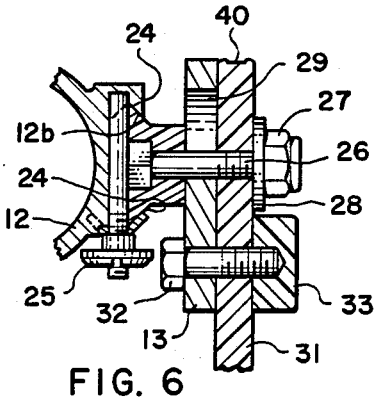

The second sight mounting member 17 is shown enlarged and in cross section in FIG. 6, which also shows the attachment means for attaching it to bracket 13. Similarly to sight mounting member 16, member 17 is preferably fashioned from a molded elongate block, having similar wedge-shaped surfaces 24 which slidably engage respective mating surfaces 12*b* on the scope sight, and a similar locking means 25 for locking the scope sight in place. Likewise, a post member 26 is employed which is threaded on one end and has a hexagonal head on the opposite end which mates with a hexagonal recess in sight mounting member 17. A self-locking nut 27 and an optional washer 28 are also employed as before. However, instead of passing through a hole in bracket 13, post member 26 passes through an arcuate slot 29 in bracket 13 which has its center coincident with the axis of pivot post 20, as shown in FIGS. 1, 2, and 6. Thus, as sight mounting member 16 pivots about pivot post 20, second sight mounting member 17 moves arcuately and also necessarily pivots as post member 26 moves arcuately in slot 29.

In addition, post member 26 passes through an arcuate slot 30 in cam member 31 as shown in FIGS. 1, 2, and 5. Self locking nut 27 is tightened just sufficiently that second sight mounting member 17 is restrained from moving axially, and also so that the force required to rotate post member 26 with respect to bracket 13 is significantly less than the force required to rotate post member 26 with respect to the nut means. Thus, post member 26, second sight mounting member 17, and nut 27 rotate freely together when the scope sight is adjusted. Furthermore, repetitive rotations do not result in either tightening or loosening of the nut means on the post member.

Figure 3:
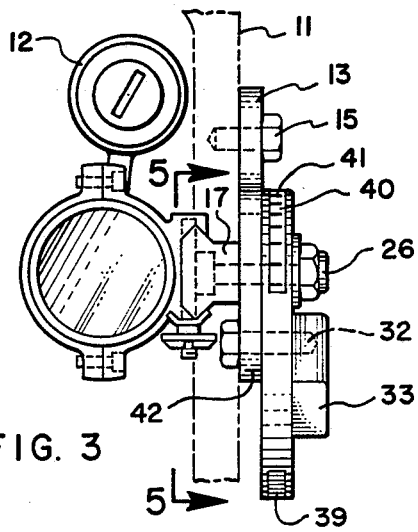
Figure 4:
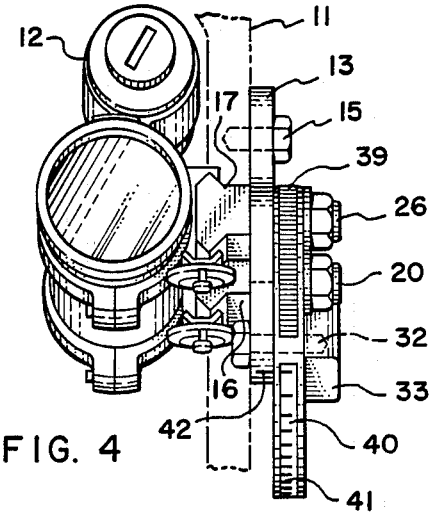

Cam member 31 is a circular molded disc which is centrally attached to bracket 13 by means of a screw 32 as best shown in FIGS. 3, 4, and 6. Arcuate slot 30 has its center offset from the center of cam member 31 and thus serves as a cam for driving post member 26 along arcuate slot 30 as cam member 31 is rotated. Handle member 33 is attached to cam member 31 for facilitating operator adjustment and is threadedly engaged with screw 32. In practice, screw 32 is tightened just sufficiently to protect aganist unintentional rotation of cam member 31, but not so tight as to prevent operator adjustment. After adjustment, if desired, screw 32 may be further tightened so as to prevent any further rotation of cam member 31.

Figure 8:
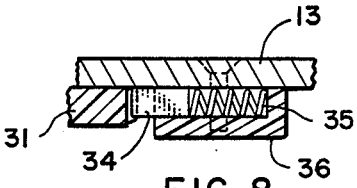

Cam member 31 also has approximately forty serrations 39 along a portion of its periphery as shown in FIGS. 1, 2, and 5. These serrations serve as detents. A cooperating catch member 34, as shown in FIGS. 1, 2, 5, and 8, engages the detents. This catch member is spring loaded by spring 35 as shown in FIG. 8 and has a wedge-shaped head, 34*a* as shown in FIGS. 1 and 8 which arrangement thereby provides a detent mechanism having closely spaced detent positions. Catch member 34 and spring 35 are housed in a molded block 36 which in turn is fastened to bracket 13 by screws 37 and 38, FIGS. 1 and 5. Thus, as cam member 31 is rotated, catch member 34 successively engages serrations 39. Thus, as the scope sight is adjusted for a particular target range by rotating cam member 31, the detents and catch member protect against further rotation unless the operator applies force to handle member 33.

If finer range adjustments are desired than are allowed by the detent means, catch member 34 may be removed by removing screws 37 and 38. This, then, will allow continuously variable adjustment of cam member 31 to any position within its limits. In this mode of operation screw 32 is tightened snugly, but not tightly, so as to require a reasonable amount of force by the operator to rotate cam member 31. After adjustment to a desired range, screw 32 may be tightened still further so as to prevent inadvertent misadjustment.

Cam member 31 is also provided with a depressed region 40 extending part way around its perimeter, as shown in FIGS. 3, 4, and 6. This depressed region serves to hold marking means 41 for identifying range settings. A cooperating index mark 42 is located on the end of bracket 13 as shown in FIGS. 3 and 4. Said marking means may comprise a thin replaceable strip of any suitable material, such as paper or plastic, having means for marking indicia lines or numbers thereon, which strip can be inserted in said depressed region and attached thereto by a suitable adhesive. Alternatively, a substance such as correction fluid, commonly called white out, may be applied to the depressed region and range indicia scribed thereon as the bow is targeted.

Figure 9:
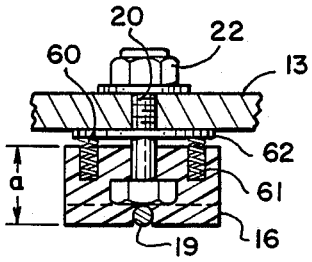
Figure 13:
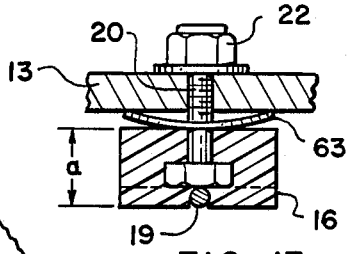

The invention also provides optional means for transverse adjustment of the launch trajectory sight line angle to compensate for slight imperfections in bows or variations between bows or archers. This means comprises an adjustment whereby sight mounting member 16 may be adjusted perpendicularly with respect to bracket 13, as shown in FIG. 9. This is accomplished by means of two compression springs 60 and 61 which are inserted in mating cavities in sight mounting member 16. A thin washer 62 is interposed between the ends of said springs and bracket 13. Thus, as nut 22 is tightened or loosened on pivot post 20, sight mounting member 16 is drawn closer to, or spaced further from, bracket 13, at all times being held snugly in position by the action of springs 60 and 61. At the same time, sight mounting member 16 is free to pivot as washer 62 has a low coefficient of friction with respect to bracket 13. Also, sight mounting member 16 has a lesser thickness dimension, shown as "a", than has second sight mounting member 17. Thus, the portion of the scope sight attached to sight mounting member 16 may be adjusted so as to be closer to, or farther from, the bow handle, in a transverse sense, than is the portion of the scope sight attached to second sight mounting member 17. Alternatively, a resilient washer 63 may be employed rather than springs 60 and 61, as shown in FIG. 13.

Figure 10:
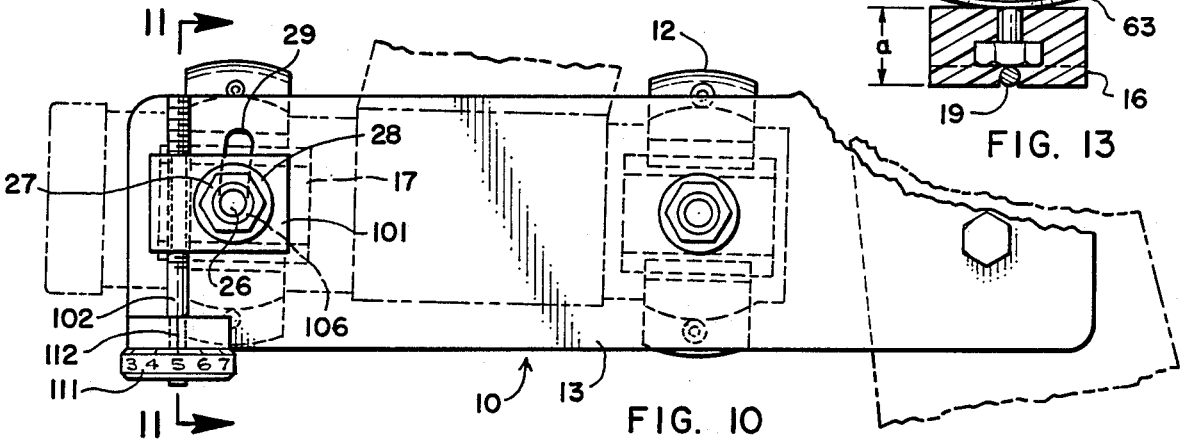
Figure 11:
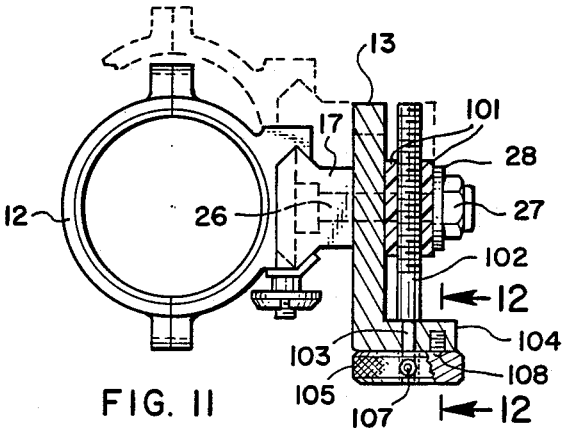
Figure 12:
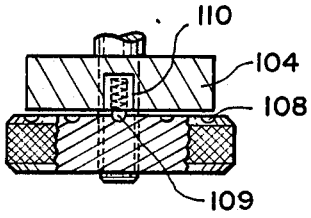

The invention also comprises a second embodiment having an alternative means for range adjustment, as shown in FIGS. 10, 11, and 12. In this embodiment, the second sight mounting member attachment means comprises a post member 26, a nut 27, and a washer 28, similar to those employed in the first embodiment, but having a movable sight adjustment member 101 utilized instead of a cam member such as 31. Sight adjustment member 101 comprises a rectangular molded block fashioned from a suitable molding material. Sight adjustment member 101 is threadedly engaged with an adjustment screw 102 which in turn passes through a journal hole 103 in an angle portion 104 of bracket 13, and has a thumbwheel 105 on the end opposite the threads for facilitating operator adjustment. Thus, as the operator rotates the thumbwheel 105 sight adjustment member 101 moves linearly, and post member 26 moves arcuately in slot 29. In order to allow this arcuate motion of post member 26, the hole 106 in sight adjustment member 101 through which it passes is elongated in the form of a slot, as shown in FIG. 10. Alternatively, it may be simply an oversize round hole.

Thumbwheel 105 is affixed to adjustment screw 102 by means of a set screw 107, FIG. 11, and also has position detents 108 around the periphery of its face apposite the face of bracket member 104, as shown in FIG. 12. A spring loaded ball check 109 with its actuating spring 110 is housed in bracket member 104. Thus, as the thumbwheel is rotated, the ball check engages successive position detents, thus inhibiting motion unless rotational force is applied to the thumbwheel.

Marking means 111 may also be provided around the periphery of thumbwheel 105 as shown in FIG. 10. This may comprise indicia marks or numbers applied to the periphery of the thumbwheel or may be a thin strip affixed, as by gluing, to the periphery, which strip carries such indicia marks or numbers. An index mark 112 is marked on bracket member 104 as shown in FIG. 11.

The pitch of the threads on adjustment screw 102 is preferably such that one complete rotation of thumbwheel 105 moves adjustment member 101 through its entire travel distance. Thus, indicia markings on the thumbwheel will correspond unambiguously to selected ranges. This requires that the diameter of the thumbwheel be sufficient that the desired number of detent positions, preferably 30 or 40, can be employed, consistent with a practical ball check arrangement. However, if desired, the pitch of the threads can be such that two, or even more, rotations of the thumbwheel are necessary to move adjustment member 101 through its travel distance, thus providing for adjustments of trajectory angle even more closely spaced than 20 minutes of arc or, alternatively, permitting a smaller diameter of the thumbwheel.

If finer range adjustments are desired than are allowed by the detent and ball check arrangement, the ball check 109 may be removed by loosening set screw 107, removing thumbwheel 105, removing ball check 109 including spring 110, replacing thumbwheel 105, and retightening set screw 107. This, then, will allow continuously variable adjustment of sight adjustment member 101 within its limits. In this mode of operation, nut 27 is tightened snugly, but not tightly, so as to require a reasonable amount of force by the operator to turn adjustment screw 102 by means of thumbwheel 105 and thus adjust the position of sight adjustment member 101. After adjustment to a desired range, nut 27 may be tightened still further so as to prevent inadvertent misadjustment.

Whereas this invention is here illustrated and described with specific reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. A mounting device for attaching a sight in operative position on an archery bow, comprising bracket means adapted to be fastened to the bow; a first sight mounting member; attachment means pivotally attaching said first sight mounting member to said bracket means; a second sight mounting member; attachment means movably attaching said second sight mounting member to said bracket means, and comprising an arcuate slot formed in said bracket means and a post member extending through said slot and engaging said second sight mounting member; and means comprising a cam member for moving said second sight mounting member in an arcuate path about said first sight mounting member attachment means.

2. A mounting device in accordance with claim 1, wherein the cam member comprises a circular disc centrally and pivotally attached to the bracket means and further having an arcuate off-center slot formed therein in which said post member is positioned, thus serving as a cam to move said post member along the arcuate slot in said bracket means as said circular disc is rotated about its center.

3. A mounting device in accordance with claim 2, wherein the cam member has detent means along at least a portion of its periphery.

4. A mounting device in accordance with claim 3, wherein the detent means comprises a series of serrations.

5. A mounting device in accordance with claim 4, wherein the catch member has a wedge-shaped head which engages the detent means.

6. A mounting device in accordance with claim 3, having a catch member attached to the bracket means which cooperatively engages the detent means on the cam member.

7. A mounting device in accordance with claim 6, wherein the catch member has spring loaded means for causing positive and cooperative engagement of said catch member with the detent means on the cam member.

8. A mounting device in accordance with claim 6, having means for removing the catch member from the bracket means, thus allowing continuously variable adjustment of the cam member.

9. A mounting device in accordance with claim 8, having means for adjustably establishing the force required by the operator to operate the cam member.

10. A mounting device in accordance with claim 2, wherein the post member extends through the slot in the bracket means, and through the slot in the cam member, said post member being threaded on one end and headed on the opposite end with the headed end being mated with said second sight mounting member so as to prevent relative rotation between the two; and nut means snugly and threadedly engaged with the threaded end of said post member having a coefficient of friction between the two such that when tightened snugly but not tightly the force required to rotate said post member with respect to said bracket member and said cam member is less than the force required to rotate said post member with respect to said nut means, the result being that said post member, said nut means, and said second sight mounting member rotate together as said second sight mounting member pivots, without said nut means tightening or loosening on said post member.

11. A mounting device in accordance with claim 10, having a washer interposed between the nut means and the cam member which washer has smooth surfaces providing a low coefficient of friction between said nut means and said washer and also between said washer and said cam member.

12. A mounting device in accordance with claim 2, wherein the cam member has means for applying numbers or other indicia markings around at least a portion of its periphery.

13. A mounting device in accordance with claim 1, wherein the cam member has a handle portion for operator adjustment.

14. A mounting device in accordance with claim 1, wherein the pivot post extends through said bracket means, is threaded on one end, and is headed on the opposite end, said headed end being mated with said first sight mounting member so as to prevent relative rotation between the two; and nut means snugly and threadedly engaged with the threaded end of said pivot post with a coefficient of friction between the two such that when tightened snugly, but not tightly, the force required to rotate said pivot post with respect to said bracket means is less than the force required to rotate said pivot post with respect to said nut means, the result being that said pivot post, said nut means, and said first sight mounting member rotate together as said sight mounting member is pivoted, without said nut means tightening or loosening on said pivot post.

15. A mounting device in accordance with claim 14, having a washer interposed between the nut means and the bracket means, which washer has smooth surfaces providing a low coefficient of friction between said nut means and said washer and also between said washer and said bracket means.

16. A mounting device in accordance with claim 1, wherein the first sight mounting member has a lesser thickness than the second sight mounting member, thus allowing for relative transverse adjustment to compensate for variations between bows or archers.

17. A mounting device in accordance with claim 1, having resilient means for adjustably spacing the first sight mounting member from the bracket means.

18. A mounting device in accordance with claim 16, wherein the resilient means comprises one or more compression springs which axially engage the first sight mounting member and axially press against the bracket means.

19. A mounting device in accordance with claim 18, wherein a washer is interposed between the springs and the bracket means, which washer has a smooth surface providing a low coefficient of friction between said washer and said bracket means.

20. A mounting device in accordance with claim 17, wherein the resilient means comprises a resilient washer interposed between the first sight mounting member and the bracket means.

21. A mounting device for attaching a sight in operative position on an archery bow, comprising bracket means adapted to be fastened to the bow; a first sight mounting member; attachment means pivotally attaching said first sight mounting member to said bracket means; a second sight mounting member; attachment means movably attaching said second sight mounting member to said bracket means and comprising an arcuate slot formed in said bracket means and a post member extending through said slot and engaging said second sight mounting member; and means comprising a movable sight adjustment member positioned against the opposite face of the bracket means from said second sight mounting member for moving said second sight mounting member in an arcuate path about said first sight mounting member attachment means; and wherein the post member is threaded on one end and headed on the other end and extends through an oversize hole or elongate slot in said sight adjustment member and also through the arcuate slot in said bracket means, which headed end is mated with said second sight mounting member, and wherein the oversize hole or elongated slot in said sight adjustment member is so configured as to permit said post member to move arcuately in the in the arcuate slot in said bracket means as said sight adjustment member moves linearly; and nut means snugly and threadedly engaged with the threaded end of said post member having a coefficient of friction between the two such that when tightened snugly, but not tightly, the force required to rotate said post member with respect to said bracket means and said movable sight adjustment member is less than the force required to rotate said post member with respect to said nut means, the result being that said post member, said nut means, and said second sight mounting member rotate together as said second sight mounting member pivots, without said nut means tightening or loosening on said post member.

22. A mounting device in accordance with claim 21, wherein the movable sight adjustment member is threadedly engaged with an adjustment screw which has a thumbwheel on one end for ease of operator adjustment and wherein said adjustment screw is journally affixed to the bracket means.

23. A mounting device in accordance with claim 22, wherein the thumbwheel has position detents around the periphery of a face apposite the bracket means and a spring loaded ball check affixed within said bracket means which cooperates with, and successively engages, said position detents as said thumbwheel is rotated.

24. A mounting device in accordance with claim 23, having means for removing the ball check, thus allowing continuously variable adjustment of the sight adjustment member.

25. A mounting device in accordance with claim 24, having means for adjustably establishing the force required by the operator to adjust the sight adjustment member.

26. A mounting device in accordance with claim 22, wherein the thumbwheel has means for applying numbers or other indicia markings around its periphery.

27. A mounting device in accordance with claim 21, having a washer interposed between the nut means and the movable sight adjustment member which washer has smooth surfaces providing a low coefficient of friction between said nut means and said washer and also between said washer and said movable sight adjustment member.

* * * * *

UNITED STATES PATENT AND TRADEMARK OFFICE

CERTIFICATE OF CORRECTION

PATENT NO. : 4,961,265

DATED : October 9, 1990

INVENTOR(S) : Kent S. Roberts

It is certified that error appears in the above-identified patent and that said Letters Patent is hereby corrected as shown below:

On the title page:
In the Abstract, line 18, "an" should be "and".
In Column 9, lines 43-44 "in the" appears twice.
The first occurence should be deleted.

Signed and Sealed this

Seventh Day of April, 1992

*Attest:*

HARRY F. MANBECK, JR.

*Attesting Officer*

*Commissioner of Patents and Trademarks*